US008575836B2

(12) United States Patent
van de Ven

(10) Patent No.: US 8,575,836 B2
(45) Date of Patent: Nov. 5, 2013

(54) LIGHTING DEVICES WITH DIFFERENTIAL LIGHT TRANSMISSION REGIONS

(75) Inventor: Antony Paul van de Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 820 days.

(21) Appl. No.: 12/796,549

(22) Filed: Jun. 8, 2010

(65) Prior Publication Data

US 2011/0298355 A1 Dec. 8, 2011

(51) Int. Cl.
*H01J 1/62* (2006.01)
*H01J 63/04* (2006.01)

(52) U.S. Cl.
USPC ..... 313/512; 313/483; 313/500; 313/501; 313/502; 313/503; 313/504; 313/505; 313/506; 313/510; 313/511

(58) Field of Classification Search
None
See application file for complete search history.

(56) References Cited

U.S. PATENT DOCUMENTS

| | | | |
|---|---|---|---|
| 6,350,041 | B1 | 2/2002 | Tarsa et al. |
| 6,465,961 | B1 | 10/2002 | Cao |
| 6,634,770 | B2 | 10/2003 | Cao |
| 6,746,885 | B2 | 6/2004 | Cao |
| 6,871,993 | B2 | 3/2005 | Hecht |
| 7,052,161 | B2 | 5/2006 | Lichtenstein et al. |
| 7,086,756 | B2 | 8/2006 | Maxik |
| 7,224,001 | B2 | 5/2007 | Cao |
| 7,293,889 | B2 | 11/2007 | Kamiya et al. |
| 7,564,180 | B2 | 7/2009 | Brandes |
| 8,227,961 | B2 * | 7/2012 | van de Ven ..... 313/46 |
| 2007/0170447 | A1 | 7/2007 | Negley et al. |
| 2007/0263405 | A1 | 11/2007 | Ng et al. |
| 2007/0267976 | A1 | 11/2007 | Bohler et al. |
| 2008/0308825 | A1 | 12/2008 | Chakraborty et al. |
| 2011/0298350 | A1 | 12/2011 | Van de Ven |
| 2011/0298371 | A1 | 12/2011 | Brandes |

FOREIGN PATENT DOCUMENTS

| | | | |
|---|---|---|---|
| JP | 2001-291406 | A | 10/2001 |
| JP | 2005-183193 | A | 7/2005 |
| JP | 2010-073438 | A2 | 4/2010 |
| JP | 2010-103404 | A | 5/2010 |
| KR | 10-2004-0063994 | A | 7/2004 |
| WO | WO-0034709 | A1 | 6/2000 |
| WO | 2004100213 | A1 | 11/2004 |
| WO | 2008134056 | A2 | 11/2008 |

OTHER PUBLICATIONS

International Search Report issued in International Patent Application No. PCT/US2011/039084 on Feb. 17, 2012.

(Continued)

*Primary Examiner* — Natalie Walford
(74) *Attorney, Agent, or Firm* — Vincent K. Gustafson; Jenkins, Wilson, Taylor & Hunt, P.A.

(57) ABSTRACT

A LED lamp including a cover with first and second transmissive regions that differently affect light emissions (e.g., with respect to diffusion, color, or other characteristics) transmitted therethrough. One or more apertures may be defined in a diffusive cover for a LED lamp to permit flow of air and escape of heat, and also to permit escape of directly emitted or reverse scattered light proximate to a base of the LED lamp. Multiple diffuser segments may be overlapped with intervening apertures.

49 Claims, 5 Drawing Sheets

(56) References Cited

OTHER PUBLICATIONS

General Electric Co., LED Lighting Press Release, Apr. 14, 2010, accessed at http://www.geconsumerproducts.com/pressroom/press_releases/lighting/led_lighting/2010_LED_A_Line.html.
General Electric Co., LED Lighting Press Release, Apr. 14, 2010, "GE Energy smart LED Omnidirectional lightdistribution comparison", p. 1, accessed at "http://www.geconsumerproducts.com/pressroom/press_releases/lighting/led_lighting/2010_LED_A_Line.htm".
Popular Science Online Article, "Updating Edison: All over light", Image 2 of 4, Jul. 30, 2010, p. 1, accessed at http://www.popsci.com/gadgets/gallery/2010-07/updating-edison.
PSFK Online Article, "GE's Low Power. Long Lasting LED Bulb," Apr. 14, 2010, accessed at http://www.psfk.com/2010/04/ges-low-power-long-lasting-led-bulb.html.
Unpublished U.S. Appl. No. 12/796,555.
Unpublished U.S. Appl. No. 12/794,559.

* cited by examiner

LIGHTING DEVICES WITH DIFFERENTIAL LIGHT TRANSMISSION REGIONS

FIELD OF THE INVENTION

The present invention relates to solid state lighting devices.

DESCRIPTION OF THE RELATED ART

Light emitting diodes (LEDs) are solid state devices that convert electric energy to light, and generally include one or more active layers of semiconductor material sandwiched between oppositely doped layers. When bias is applied across doped layers, holes and electrons are injected into one or more active layers where they recombine to generate light that is emitted from the device. Laser diodes are solid state emitters that operate according to similar principles.

Solid state light sources may be utilized to provide colored (e.g., non-white) or white LED light (e.g., perceived as being white or near-white). White solid state emitters have been investigated as potential replacements for white incandescent lamps. A representative example of a white LED lamp includes a package of a blue LED chip (e.g., made of InGaN and/or GaN), coated with a phosphor (typically YAG:Ce) that absorbs at least a portion of the blue light and re-emits yellow light, with the combined yellow and blue emissions providing light that is perceived as white or near-white in character. If the combined yellow and blue light is perceived as yellow or green, it can be referred to as 'blue shifted yellow' ("BSY") light or 'blue shifted green' ("BSG") light. Addition of red spectral output from a solid state emitter or lumiphoric material (e.g., phosphor) may be used to increase the warmth of the white light. As an alternative to phosphor-based white LEDs, combined emission of red, blue, and green solid state emitters and/or lumiphors may also be perceived as white or near-white in character. Another approach for producing white light is to stimulate phosphors or dyes of multiple colors with a violet or ultraviolet LED source. A solid state lighting device may include, for example, at least one organic or inorganic light emitting diode and/or laser.

Many modern lighting applications require high power solid state emitters to provide a desired level of brightness. Emissions from high power LEDs are often transmitted through a diffuser to create light of a more diffuse and pleasing character. High power LEDs can draw large currents, thereby generating significant amounts of heat that must be dissipated. Heat dissipating elements such as heatsinks are commonly provided in thermal communication with high intensity LEDs, since is necessary to prevent a LED from operating at an unduly high junction temperature in order to increase reliability and prolong service life of the LED.

It would be desirable to provide a LED light bulb capable of replacing an incandescent bulb without sacrificing light output characteristics, but various limitations have hindered widespread implementation of LED light bulbs. In the context of a conventional high-output LED light bulb, a heatsink is typically arranged between the base and globe portions of the bulb. Unfortunately, a heatsink of sufficient size to dissipate the quantity of heat generated by the LED(s) tends to block output of light proximate to the base of the bulb. Accordingly, when a conventional LED light bulb is placed pointing upward in a table lamp, the resulting low intensity of light output in an area below the bulb and shadows are not pleasing to many users. It would be desirable to enhance light output proximate to the base of a LED light bulb. It would also be desirable to tailor output characteristics of a LED light bulb for a desired end use.

SUMMARY OF THE INVENTION

The present invention relates in various embodiments to a LED lamp including a cover with a first transmissive region proximate to a LED support structure and with a second transmissive region distal from a LED support structure, wherein the first transmissive region and the second transmissive region differently affect light emissions transmitted therethrough.

In one aspect, the invention relates to a LED lamp comprising a cover bounding an interior volume; and at least one LED disposed within the interior volume and supported by a support structure; wherein the cover includes (a) a non-diffusing portion proximate to the support structure and arranged to permit passage of substantially undiffused light, and (b) a diffusing portion distal from the support structure and arranged to permit passage of diffused light.

In another aspect, the invention relates to a LED lamp comprising a cover bounding an interior volume; at least one LED disposed within the interior volume and supported by a support structure; wherein the cover includes a first transmissive region proximate to the support structure and a second transmissive region distal from the support structure; and wherein, relative to one another, the first transmissive region and the second transmissive region differently affect at least one of (a) diffusion, and (b) color, of LED light emissions transmitted therethrough.

In a further aspect, the invention relates to a LED lamp comprising a cover including plurality of diffuser portions and defining an interior volume; and at least one LED disposed within the interior volume and supported by a support structure; wherein the cover comprises a plurality of apertures defined between the plurality of diffuser portions, and the plurality of apertures permit fluid communication between the interior volume and an ambient environment In another aspect, any of the foregoing aspects and/or other features and embodiments disclosed herein may be combined for additional advantage.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
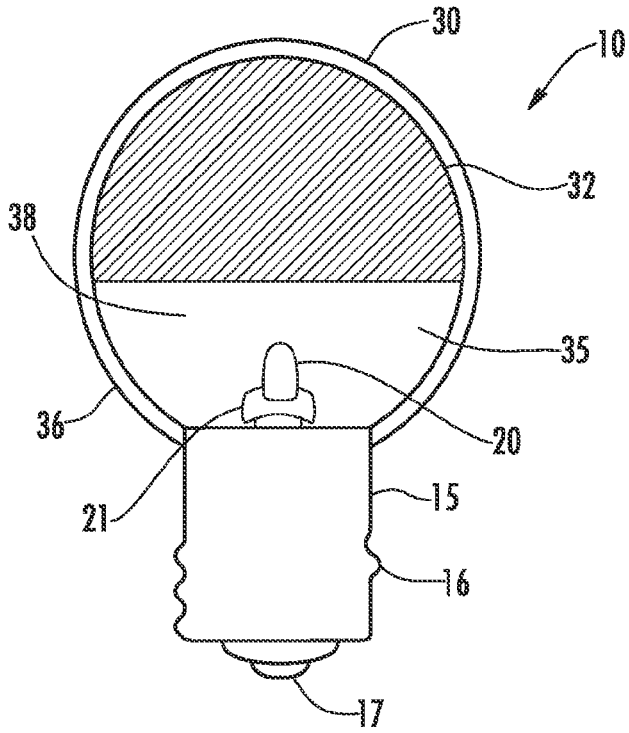
FIG. 1 is a cross-sectional schematic view of a LED light bulb according to a first embodiment, including a cover having an opening or transparent portion proximate to a support structure of a LED, with the cover having a diffusing portion distal from the support structure, and with a LED not being significantly elevated within an interior volume defined by the cover.

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the drawings, the size and relative sizes of layers and regions may be exaggerated for clarity.

Unless otherwise defined, terms (including technical and scientific terms) used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Unless the absence of one or more elements is specifically recited, the terms "comprising," "including," and "having" as used herein should be interpreted as open-ended terms that do not preclude presence of one or more elements.

As used herein, the terms "solid state light emitter" or "solid state light emitting device" may include a light emitting diode, laser diode and/or other semiconductor device which includes one or more semiconductor layers. A solid state light emitter generates a steady state thermal load upon application of an operating current and voltage to the solid state emitter. Such steady state thermal load and operating current and voltage are understood to correspond to operation of the solid state emitter at a level that maximizes emissive output at an appropriately long operating life (preferably at least about 5000 hours, more preferably at least about 10,000 hours, more preferably still at least about 20,000 hours).

Solid state light emitters may be used individually or in combinations, optionally together with one or more luminescent materials (e.g., phosphors, scintillators, lumiphoric inks) and/or filters, to generate light of desired perceived colors (including combinations of colors that may be perceived as white). Inclusion of luminescent (also called lumiphoric') materials in LED devices may be accomplished by adding such materials to encapsulants, adding such materials to lenses, or by direct coating onto LEDs. Other materials, such as dispersers and/or index matching materials, may be included in such encapsulants.

The present invention relates in various embodiments to a LED lamp including a cover with a first transmissive region proximate to a LED support structure and with a second transmissive region distal from a LED support structure, wherein the first transmissive region and the second transmissive region differently affect light emissions transmitted therethrough.

Relative to one another, first and second transmissive regions may differ with respect to characteristics such as (but not limited to) the following: presence or absence of material; difference in diffusive character of materials; presence or absence of lumiphors (e.g., phosphors); presence or absence of color filters; difference in thickness; difference in patterning; difference in surface finish; and difference in optical transmissivity or opacity.

In certain embodiments, a transparent material or opening is provided as a portion of a LED light bulb cover dispose proximate to a LED support structure. Presence of such transparent material or opening enables greater escape of light emissions proximate to a base portion of the light bulb, thus alleviating problems associated with limited light output in such region of a LED light bulb. Additionally or alternatively, at least one aperture may be formed in a portion of a cover pistol from a LED support structure. Presence of at least one opening and/or aperture as described above further enables escape of heat from the interior volume of a LED light bulb, thereby desirably reducing LED junction temperatures, and lessening requirements for external heatsinks. Reduction in external heatsink requirements may also lessen the light obstructive character of such heatsinks.

In one embodiment, a cover for a LED light bulb includes a non-diffusing portion proximate to a LED support structure, and includes a diffusing portion distal from the LED support structure. A non-diffusing portion may include at least one opening, and/or at least one substantially transparent material. In certain embodiments, a non-diffusing portion may be arranged to permit passage of direct unreflected light emissions from at least one LED within a LED light bulb. In certain embodiments, a non-diffusing portion may be arranged to permit passage of reverse scattered light reflected by a diffusing portion of the LED light bulb cover.

In one embodiment, a diffusing portion of a LED light bulb cover includes at least one aperture arranged to permit fluid communication between an ambient environment and an interior volume defined by the cover. In one embodiment, this at least one aperture is arranged to disallow significant passage of undiffused light emissions from one or more LED arranged within the LED light bulb. In one embodiment, a LED light bulb includes a diffusing portion including at least one aperture and further includes a non-diffusing portion with at least one opening.

In one embodiment, a diffusing portion of a LED light bulb cover includes a plurality of overlapping diffuser segments. At least one aperture may be defined between different segments of these diffuser segments.

Various shapes that he employed for a boundary between first and second transmissive portions (e.g., a diffusing portion and a non-diffusing portion) of a LED light bulb cover. In one embodiment, such a boundary is in the form of a linear boundary arranged substantially perpendicular to a substantially central axis definable through the support structure and an emitter mounting area. In one embodiment, such a boundary is in the form of a linear boundary arranged at an angle (i.e., non-perpendicular) relative to a substantially central axis definable through the support structure and an emitter mounting area. In one embodiment, such a boundary comprises a feathered or sawtooth boundary to avoid a sharp transition in light output along such boundary. In one embodiment, a boundary includes a transitional diffusing portion, such as may include a priority of zones having different diffusion characteristics to provide a graduated diffusion transition.

In one embodiment, a first transmissive region and a second transmissive region of a cover for a LED lighting device (e.g., a LED light bulb) differently affect at least one of (a) diffusion, and (b) color, of LED light emissions transmitted therethrough. Color may be affected by color filters and/or presence or absence of lumiphors (e.g., phosphors) arranged to interact with light emitted by one or more LEDs. Color may also be affected by independent operation of different colored emitters within a LED lighting device. The different colored emitters may constitute different colored LEDs or different colored lumiphors that may be stimulated by LEDs having similar or different output characteristics.

In one embodiment, a LED lamp (e.g., as embodied in an LED light bulb) includes a cover having a plurality of diffuser portions and a plurality of apertures defined between plurality of diffuser portions. Such apertures may desirably permit fluid communication between an interior volume of any LED lamp and an ambient environment. In one embodiment, such apertures may be arranged to disallow significant passage of undiffused light emissions from the at least one LED. A cover for such a LED lighting device may further include a non-diffusing region proximate to the support structure and arranged to permit passage of substantially undiffused light. Such cover may include a non-diffusing region proximate to a LED support structure, and the non-diffusing region may be embodied in an opening and/or at least one substantially transparent material.

Referring to the drawings, FIG. 1 illustrates a LED light bulb (or lamp) 10 according to one embodiment of the present invention. The bulb 10 includes a cover 30, a diffuser portion 32 of the cover 30, and a non-diffuser portion 35 of the cover 30, with risers 36 arranged to contact the diffuser portion 32. A LED support structure 15 is arranged below a LED 20 and associated substrate 21, with the LED 20 being disposed in an interior volume 38 defined by the cover 30. Electrical contacts 16, 17 are arranged along a base end of the LED support structure 15, including a lateral (e.g., threaded) contact 16 and a foot contact 17. The non-diffusive portion 35 may embody a substantially transparent material or an opening (i.e., absence of material). Risers 36 may be provided to contact and support the diffusive portion 32 of the cover 30. If the non-diffusive portion comprises a transparent material suitable to support the diffusive portion 32, then the risers 36 may be omitted. The diffusive portion 32 preferably constitutes the majority of the cover 30, along at least upper and upper side portions of the cover 30. The diffusive portion 32 of the cover 30 may constitute a pattern, a raised or roughened surface, or other optically diffusive structure, which may be formed along an interior surface, a core, or an exterior surface of the cover 30. In one embodiment, the diffusive portion 32 comprises a polymeric or a glass material.

As shown in FIG. 1, the LED 20 and substrate 21 are not particularly elevated relative to a terminus of the support structure 15, such that light emissions from the LED 20 may travel laterally through the non-diffusive portion 35 of the cover 30 in a direct line-of-sight manner.

Figure 2:
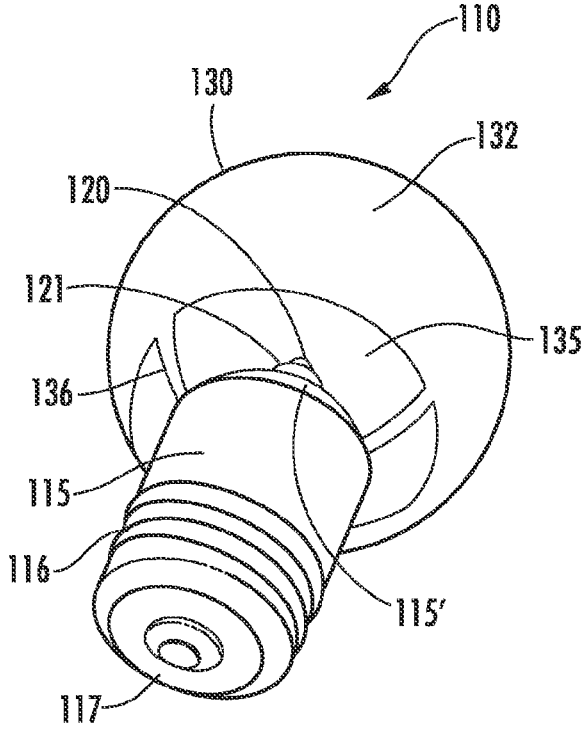
FIG. 2 is a perspective view of a LED light bulb according to another embodiment, including a cover having an opening proximate to a support structure for the LED, with the cover having a diffusing portion distal from the support structure, and with the LED being elevated within an interior volume defined by the cover.

Referring to FIG. 2, a LED light bulb (or lamp) 110 according to another embodiment includes a cover 130 having an opening 135 proximate to a support structure 115, 115' for the LED 120, with the cover 130 having a diffusing portion 132 distal from the support structure 115, 115', and with the LED 120 being elevated by a portion of the support structure 115' within an interior volume defined by the cover 130. A base end of the support structure further includes a lateral contact 116 and foot contact 117 arranged for mating with an electrical receptacle for supplying electrical current to the LED 120 (e.g., via conductors and/or circuit elements (not shown) disposed within the support structure 115, 115'). Risers 136 span between the support structure 115 and the non-diffusive portion 132 of the cover 130 in order to support the cover 130.

Figure 3:
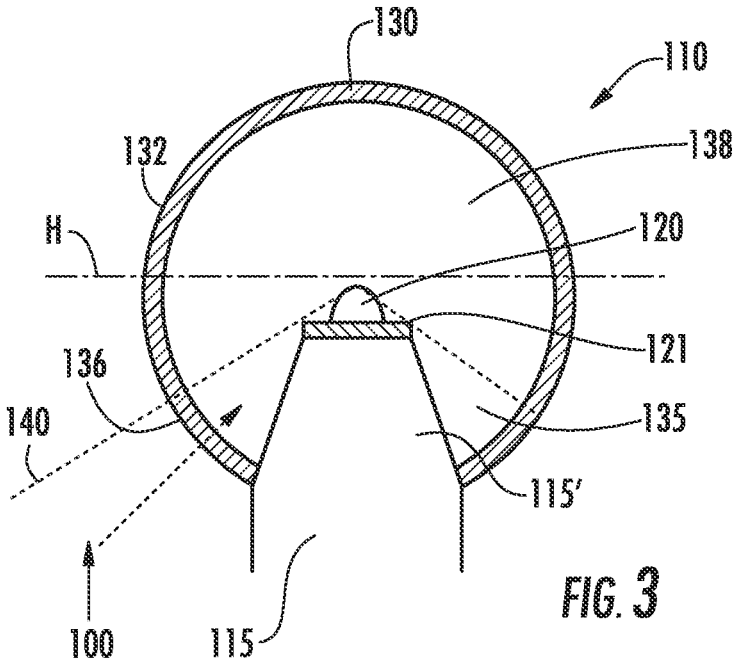
FIG. 3 is a cross-sectional schematic view of a portion of a LED light bulb according to one embodiment, showing a cover having an opening or transparent portion proximate to a support structure of a LED, and a diffusing portion distal from the support structure, wherein direct viewing of the LED through the opening or transparent portion is limited by protrusion of a portion of the support structure into an interior volume defined by the cover.

FIG. 3 shows a portion of the LED light bulb 110 illustrated in FIG. 2. The LED 120 and associated substrate 120 are elevated (i.e., at a height "H") within the interior volume 138 defined by the cover 130. Due in part to such elevation, and in part to the relatively small size and placement of the non-diffusive portion 135, sight lines from a viewer 100 to the LED 120 are obstructed (e.g., by an edge of the substrate and by a lower extent of the diffusive portion 132 of the cover 130. A lowermost beam 140 emitted by the LED 120 is arranged to travel directly through the diffusive portion 132 of the cover 130.

FIGS. 1-3 in combination demonstrate that sizing and placement of diffusive and non-diffusive portions of a cover for a LED light bulb, and elevation of a LED within such a cover, may be selected to enable or prevent passage of direct unreflected light emissions (and therefore viewing) of the LED.

Figure 4:
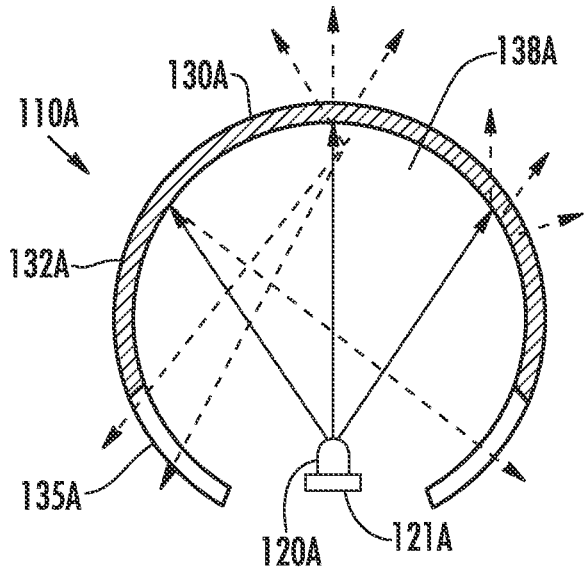
FIG. 4 is a cross-sectional schematic view of a portion of a LED light bulb according to one embodiment, illustrating the phenomenon of backscattering of light within a diffusive portion of a cover, and escape of backscattered light through an opening or transparent portion arranged proximate to a support structure for the LED, wherein the LED is not significantly elevated within an interior volume defined a cover.

FIG. 4 is a cross-sectional schematic view of a portion of a LED light bulb 110A according to one embodiment similar to that disclosed in FIGS. 2-3, but with the LED 120A not being particularly elevated within the interior volume 138A defined by the cover 130A. FIG. 4 illustrates the phenomenon of backscattering (reverse scattering) of light within the diffusive portion 132A of the cover 130A, and passage of this backscattered light through a nondiffusive portion 135A (e.g., an opening or transparent portion) arranged proximate to a substrate 121A for the LED 120A. Such figure demonstrates that sizing and placement of diffusive and non-diffusive portions of a cover for a LED light bulb, and elevation of a LED within such a cover (as well as reflective character of a diffuser), may be selected to enable or prevent passage of direct unreflected light emissions of the LED 120A.

Openings and/or apertures defined in the cover of a LED light bulb may be utilized to permit the escape of heat and circulation of air through the interior volume of the bulb, by permitting fluid communication with an ambient environment of the bulb.

Figure 5:
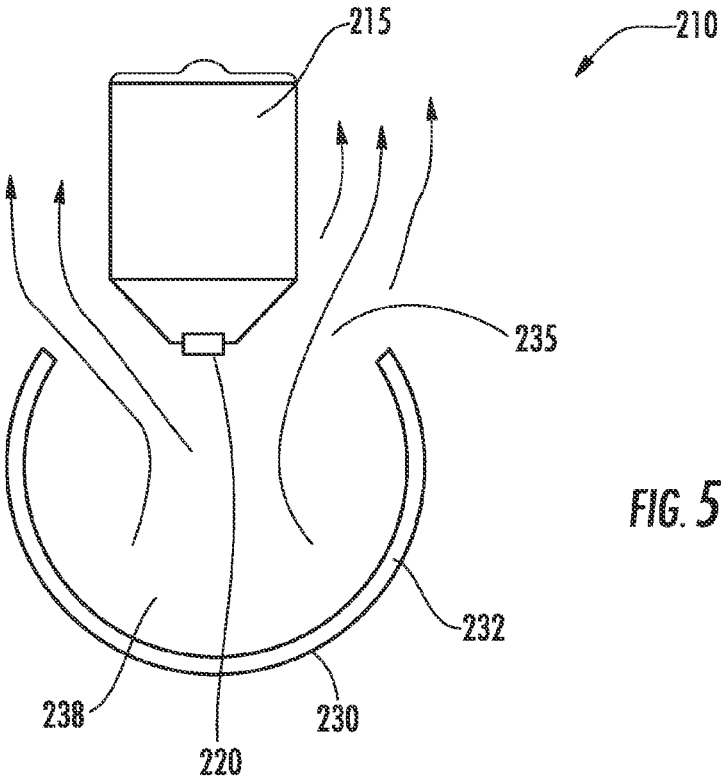
FIG. 5 is a cross-sectional schematic view of a LED light bulb according to one embodiment, showing the escape of heat through an opening arranged proximate to a support structure for the LED

FIG. 5 illustrates a LED light bulb 210 including a LED support structure 215, a LED 220, and a cover 230 defining an interior volume 238 containing the LED 220, with the cover including a diffusive portion 232 and a non-diffusive portion 235 in the form of one or more openings 235. When the bulb 210 is oriented facing downward, the opening(s) 235 are oriented to permit heat generated by the LED 220 to escape via natural convection, as illustrated by the arrows in FIG. 5.

Figure 6:
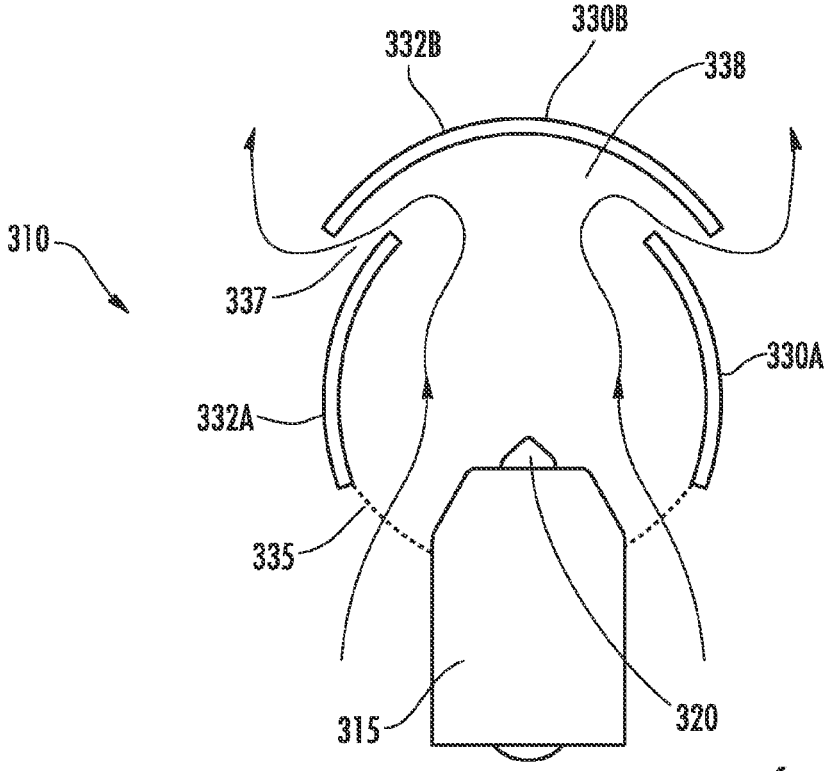
FIG. 6 is a cross-sectional schematic view of a LED light bulb according to one embodiment, including an opening arranged proximate to a support structure for the LED, and a diffusive cover including an aperture defined between a lower segment of the diffusive cover and an overlapping upper segment of the diffusive cover, with the figure illustrating a flow of air through the light bulb.

As shown in FIG. 6, a LED light bulb 310 may include one or more non-diffusive portions of a cover 330 (composed of portions 330A, 330B) in the form of one or more openings 335 disposed proximate to a LED support structure 315, and a diffusive portion of the cover 330 in the form of diffusive segments 332A, 332B. One or more apertures 337 are disposed between the diffusive segments 332A, 332B. Presence of the one or more openings 335 and one or more apertures 337 enables flow of air through the interior volume 338 defined by the cover 330 of the bulb 310. Preferably, at least a portion of one (e.g., upper) diffusive segment 332B overlaps another (e.g., lower) diffusive segment 332A, so that the at least one aperture 337 arranged among the diffusive segments does not allow significant passage of undiffused light emissions from the at least one LED 320.

Figure 7:
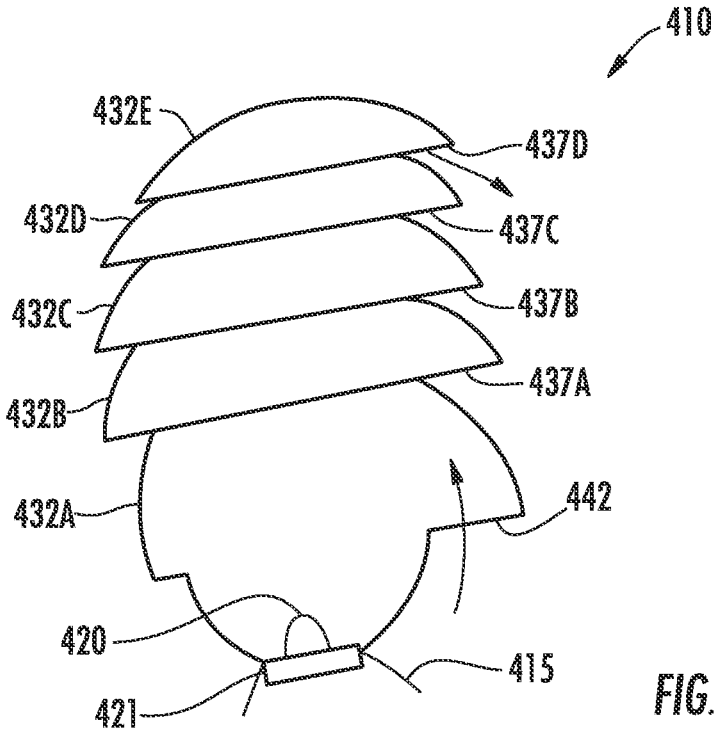
FIG. 7 is a partial cross-sectional schematic view of a LED light bulb according to one embodiment, including multiple diffuser segments arranged in a stack with at least one aperture defined between such segments, and illustrating a flow of air through the light bulb.
Figure 8:
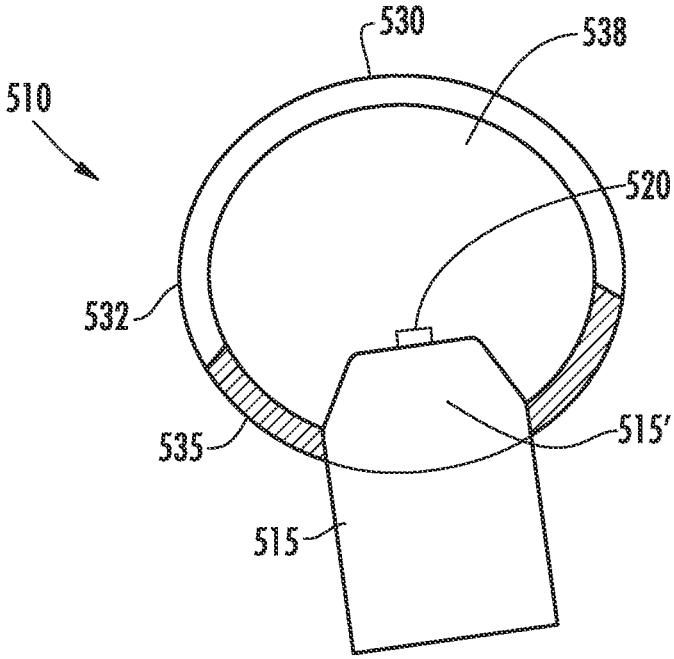
FIG. 8 is a cross-sectional schematic view of a LED light bulb according to one embodiment, including a cover with a first transmissive region proximate to a support structure for the LED, and with a second transmissive region distal from the support structure.

As illustrated in FIG. 7, a LED light bulb 410 may include a cover including multiple diffusive material segments 432A-432E, with apertures 437A-437D arranged between adjacent diffusive material segments 432A-432E to permit passage of air and escape of heat generated by the at least one LED 420, which is mounted to a substrate 420 and supported by a LED support element 415. A further opening may 442 may be defined in one diffusive material segment 432A or another suitable portion of the light bulb 410 to facilitate fluid communication with an ambient environment, and thereby promote cooling of the LED 420 of the light bulb 410. As shown in FIG. 7, all diffusive segments 432A-432D except for the uppermost diffusive segments 432E are overlapped by a portion of an overlying segment, to inhibit significant passage of undiffused light emissions via the apertures 437A-437D.

In one embodiment, a LED light bulb 510 includes a LED 520 supported by a support element 515 within an interior volume 538 defined by a cover 530 that includes a first transmissive region 535 proximate to the support structure 515 and a second transmissive region 532 distal from the support structure 515, wherein the first transmissive region and the second transmissive region differently affect properties (e.g., diffusion, color, or other characteristics) of LED light emissions transmitted therethrough. Relative to one another, first and second transmissive regions may differ with respect to characteristics such as (but not limited to) the following: presence or absence of material; difference in diffusive character of materials; presence or absence of lumiphors (e.g., phosphors); presence or absence of color filters; difference in thickness; difference in patterning; difference in surface finish; and difference in optical transmissivity or opacity.

Ability to select or alter diffusion characteristics, color characteristics, and/or other characteristics may be beneficial to permit a user to tailor and/or adjust a LED light bulb for a desired end use. In one embodiment, at least one of the first transmissive region 532 and the second transmissive region 535 comprises a cover portion that is removably engageable to the LED lamp 510. Such cover portion(s) may be engaged to portions of the lamp 510 in any suitable manner, including but not limited to snap fit engagement.

As illustrated in FIGS. 9A-9D, various shapes that he employed for a boundary between first and second transmissive portions (e.g., including but not limited to a diffusing portion and a non-diffusing portion) of a LED light bulb cover.

Figure 9A:
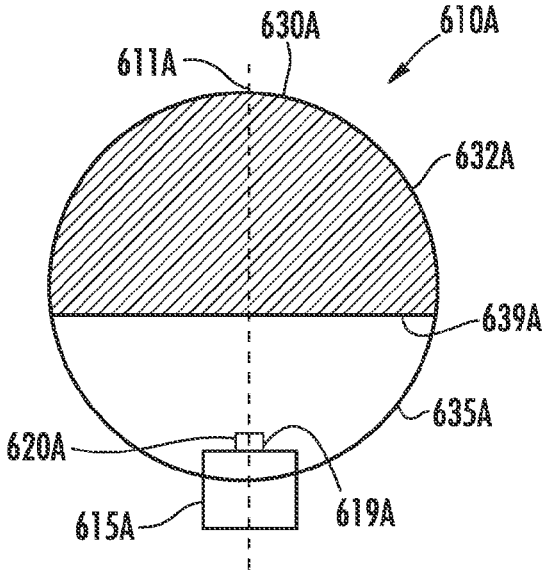
FIG. 9A is a cross-sectional schematic view of a LED light bulb according to one embodiment, including a linear boundary between a first transmissive region and second transmissive region of a cover thereof, with the boundary being arranged substantially perpendicular to a central axis of the light bulb.

Referring to FIG. 9A, a LED light bulb 610A includes a LED 620A arranged over a LED support structure 615A, and a cover 630A including a first transmissive region 632A and a second transmissive region 632B meeting at a linear boundary 639A arranged substantially perpendicular to a substantially central axis 611A definable through the support structure 615A and an emitter mounting area 619A.

Figure 9B:
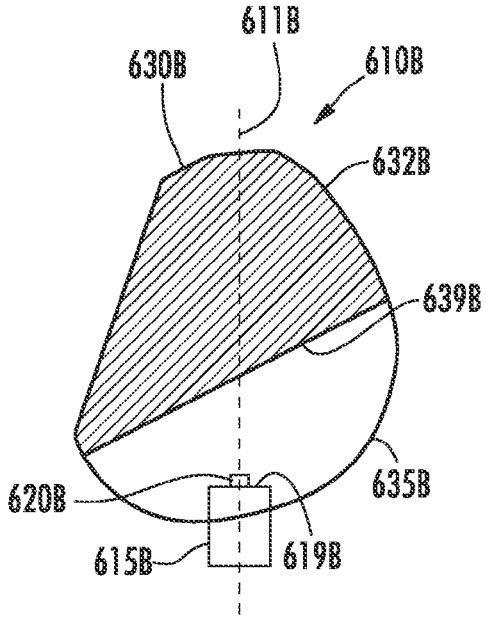
FIG. 9B is a cross-sectional schematic view of a LED light bulb according to one embodiment, including a linear boundary between a first transmissive region and second transmissive region of a cover thereof, with the boundary being angled (i.e., arranged substantially non-perpendicular) to a central axis of the light bulb.

Referring to FIG. 9B, a LED light bulb 610B includes a LED 620B arranged over a LED support structure 615B, and a cover 630B including a first transmissive region 632B and a second transmissive region 632B meeting at a linear boundary 639B arranged non-perpendicular (i.e., at an angle) to a substantially central axis 611B definable through the support structure 615B and an emitter mounting area 619B. The cover 630B may further be asymmetric in character to provide desired light output characteristics.

Figure 9C:
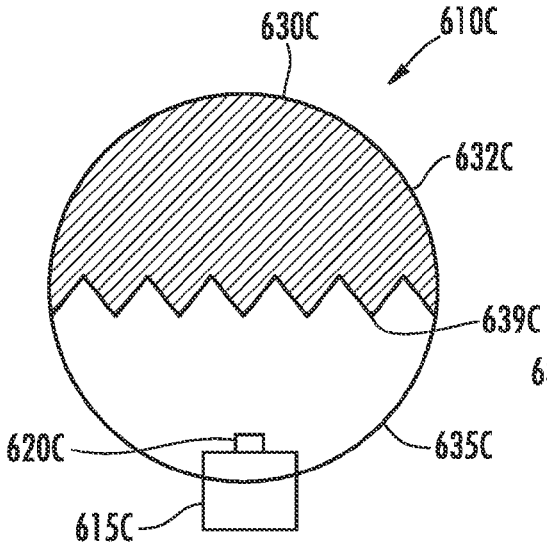
FIG. 9C is a cross-sectional schematic view of a LED light bulb according to one embodiment, including a feathered or sawtooth boundary between a first transmissive region and second transmissive region of a cover thereof.

Referring to FIG. 9C, a LED light bulb 610C includes a LED 620C arranged over a LED support structure 615C, and a cover 630C including a first transmissive region 632C and a second transmissive region 632C meeting at a feathered or sawtooth boundary 639C to avoid a sharp transition in light output along such boundary 639C.

Figure 9D:
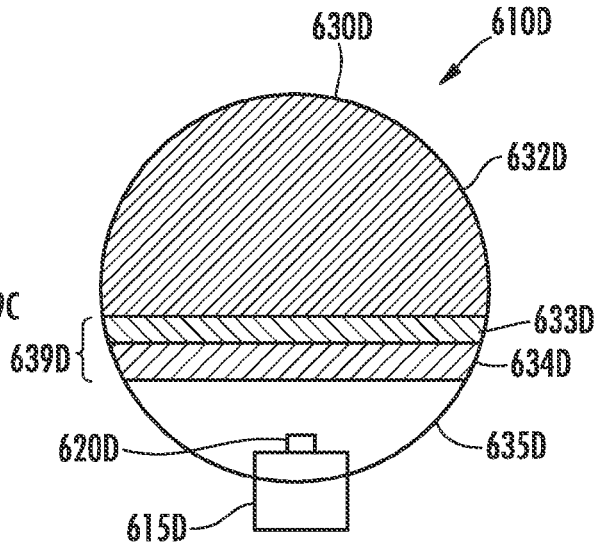
FIG. 9D is a cross-sectional schematic view of a LED light bulb according to one embodiment, including a graduated boundary between a first transmissive region and second transmissive region of a cover thereof.

Referring to FIG. 9D, a LED light bulb 610D includes a LED 620D arranged over a LED support structure 615D, and a cover 630D including a first transmissive region 632D and a second transmissive region 632D meeting at a transition boundary 639D including transition zones 633D, 634D. Such transition zones 633D, 634D may form a transition pattern. Each zone 633D, 634D may confer different characteristics to transmitted light, such as to provide a graduated transition. Such transition may involve changes in diffusion, color, or any other desirable characteristics.

One embodiment of the present invention includes a light fixture with at least one LED lamp as disposed herein. In one embodiment, a light fixture includes a plurality of LED lamps. In one embodiment, a light fixture is arranged for recessed mounting in ceiling, wall, or other surface. In another embodiment, a light fixture is arranged for track mounting. A LED lamp may be may be permanently mounted to a structure or vehicle, or constitute a manually portable device such as a flashlight.

In one embodiment, an enclosure comprises an enclosed space and at least one LED lamp or light fixture as disclosed herein, wherein upon supply of current to a power line, the at least one lighting device illuminates at least one portion of the enclosed space. In another embodiment, a structure comprises a surface or object and at least one LED lamp as disclosed herein, wherein upon supply of current to a power line, the LED lamp illuminates at least one portion of the surface or object. In another embodiment, a LED lamp as disclosed herein may be used to illuminate an area comprising at least one of the following: a swimming pool, a room, a warehouse, an indicator, a road, a vehicle, a road sign, a billboard, a ship, a toy, an electronic device, a household or industrial appliance, a boat, and aircraft, a stadium, a tree, a window, a yard, and a lamppost.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Any features disclosed herein are intended to be combinable with other features disclosed herein unless otherwise indicated. Correspondingly, the invention as hereinafter claimed is intended to be broadly construed and interpreted, as including all such variations, modifications and alternative embodiments, within its spirit and scope.

What is claimed is:

1. A light emitting diode (LED) lamp comprising:

a cover bounding an interior volume; and at least one LED disposed within the interior volume and supported by a support structure;

wherein the cover includes (i) a non-diffusing portion proximate to the support structure and arranged to permit passage of substantially undiffused light, and (ii) a diffusing portion distal from the support structure and arranged to permit passage of diffused light wherein the LED lamp comprises at least one of the following features (a) and (b):

(a) the non-diffusing portion comprises at least one opening; and (b) the diffusing portion comprises at least one aperture.

2. The LED lamp of claim 1, wherein the non-diffusing portion comprises at least one opening.

3. The LED lamp of claim 1, wherein the non-diffusing portion comprises at least one substantially transparent material.

4. The LED lamp of claim 1, wherein the non-diffusing portion is arranged to permit passage of direct unreflected light emissions from the at least one LED.

5. The LED lamp of claim 1, wherein the non-diffusing portion is arranged to permit passage of reverse scattered light reflected by the diffusing portion.

6. The LED lamp of claim 1, wherein the diffusing portion comprises at least one aperture.

7. The LED lamp of claim 6, wherein the at least one aperture is not arranged to allow significant passage of undiffused light emissions from the at least one LED.

8. The LED lamp of claim 1, wherein (a) the non-diffusing portion comprises at least one opening, and (b) the diffusing portion comprises at least one aperture.

9. The LED lamp of claim 1, wherein the diffusing portion comprises a plurality of overlapping diffuser segments.

10. The LED lamp of claim 9, wherein the diffusing portion comprises at least one aperture, and wherein the at least one aperture is defined between different diffuser segments of the plurality of overlapping diffuser segments.

11. The LED lamp of claim 1, wherein a boundary between the non-diffusing portion and the diffusing portion comprises a linear boundary arranged substantially perpendicular to a substantially central axis definable through the support structure and an emitter mounting area.

12. The LED lamp of claim 1, wherein a boundary between the non-diffusing portion and the diffusing portion comprises an angled boundary arranged non-perpendicular to a substantially central axis definable through the support structure and an emitter mounting area.

13. The LED lamp of claim 1, wherein a boundary between the non-diffusing portion and the diffusing portion comprises a feathered boundary.

14. The LED lamp of claim 1, wherein a boundary between the non-diffusing portion and the diffusing portion comprises a transitional diffusing portion.

15. The LED lamp of claim 14, wherein the transitional diffusing portion comprises a plurality of zones having different diffusion characteristics to provide a graduated diffusion transition.

16. The LED lamp of claim 1, wherein the support structure comprises a base end including a plurality of electrical contacts, and a plurality of electrical conductors in electrical communication with the plurality of electrical contacts and with the at least one LED.

17. The LED lamp of claim 1, embodied in a light bulb.

18. A light fixture comprising the LED lamp of claim 1.

19. A light emitting diode (LED) lamp comprising:

a cover bounding an interior volume;

at least one LED disposed within the interior volume and supported by a support structure;

wherein the cover includes a first transmissive region proximate to the support structure and a second transmissive region distal from the support structure; and wherein, relative to one another, the first transmissive region and the second transmissive region differently affect at least one of (a) diffusion, and (b) color, of LED light emissions transmitted therethrough and wherein the LED lamp comprises at least one of the following features (i) and (ii):

(i) at least one opening is defined in the first transmissive region; and (ii) at least one aperture is defined in the second transmissive region.

20. The LED lamp of claim 19, wherein the first transmissive region and the second transmissive region differently affect diffusion of LED light emissions transmitted therethrough.

21. The LED lamp of claim 19, wherein the first transmissive region and the second transmissive region differently affect color of LED light emissions transmitted therethrough.

22. The LED lamp of claim 19, wherein at least one of the first transmissive region and the second transmissive region comprises a lumiphor arranged to receive light of a first peak wavelength emitted by the at least one LED and re-emit light of a second peak wavelength that differs from the first peak wavelength.

23. The LED lamp of claim 19, wherein at least one of the first transmissive region and the second transmissive region comprises a color filter.

24. The LED lamp of claim 19, wherein the first transmissive region comprises a first diffuser portion, the second transmissive region comprises a second diffuser portion, and the first diffuser portion and the second diffuser portion have different diffusion characteristics.

25. The LED lamp of claim 19, wherein the second transmissive region comprises a diffusing region, and the first transmissive region comprises a non-diffusing region.

26. The LED lamp of claim 25, wherein at least one opening is defined in the first transmissive region.

27. The LED lamp of claim 19, wherein (i) at least one opening is defined in the first transmissive region, and (ii) at least one aperture is defined in the second transmissive region.

28. The LED lamp of claim 19, wherein the first transmissive region has a substantially different thickness than the second transmissive region.

29. The LED lamp of claim 19, wherein a boundary between the first transmissive region and the second transmissive region comprises a linear boundary arranged substantially perpendicular to a substantially central axis definable through the support structure and an emitter mounting area.

30. The LED lamp of claim 19, wherein a boundary between the first transmissive region and the second transmissive region comprises a linear boundary arranged non-perpendicular to a substantially central axis definable through the support structure and an emitter mounting area.

31. The LED lamp of claim 19, wherein a boundary between the first transmissive region and the second transmissive region comprises a feathered boundary.

32. The LED lamp of claim 19, wherein a boundary between the first transmissive region and the second transmissive region comprises a transitional diffusing portion.

33. The LED lamp of claim 19, wherein the support structure comprises a base end including a plurality of electrical contacts, and a plurality of electrical conductors in electrical communication with the plurality of electrical contacts and with the at least one LED.

34. The LED lamp of claim 19, wherein the at least one LED comprises a plurality of independently controllable LEDs.

35. The LED lamp of claim 19, wherein the plurality of LEDs comprises first and second LEDs of different peak wavelengths.

36. The LED lamp of claim 19, wherein at least one of the first transmissive region and the second transmissive region comprises a cover portion that is removably engageable to the LED lamp.

37. The LED lamp of claim 19, embodied in a light bulb.

38. A light fixture comprising the LED lamp of claim 19.

39. A light emitting diode (LED) lamp comprising:

a cover including a plurality of diffuser portions and defining an interior volume; and at least one LED disposed within the interior volume and supported by a support structure;

wherein the cover comprises at least one aperture defined between the plurality of diffuser portions, and the plurality of apertures permits fluid communication between the interior volume and an ambient environment.

40. The LED lamp of claim 39, wherein the plurality of apertures is not arranged to allow significant passage of undiffused light emissions from the at least one LED.

41. The LED lamp of claim 39, wherein the cover includes a non-diffusing portion proximate to the support structure and arranged to permit passage of substantially undiffused light.

42. The LED lamp of claim 41, wherein the non-diffusing portion comprises at least one opening.

43. The LED lamp of claim 41, wherein the non-diffusing portion comprises at least one transparent material.

44. The LED lamp of claim 41, wherein the non-diffusing portion is arranged to permit passage of direct unreflected light emissions from the at least one LED.

45. The LED lamp of claim 41, wherein the non-diffusing portion is arranged to permit passage of reverse scattered light reflected by the diffusing portion.

46. The LED lamp of claim 39, wherein the support structure comprises a base end including a plurality of electrical contacts, and a plurality of electrical conductors in electrical communication with the plurality of electrical contacts and with the at least one LED.

47. The LED lamp of claim 39, embodied in a light bulb.

48. A light fixture comprising the LED lamp of claim 39.

49. The LED lamp of claim 39, wherein the at least one aperture comprises a plurality of apertures.

* * * * *

UNITED STATES PATENT AND TRADEMARK OFFICE

CERTIFICATE OF CORRECTION

PATENT NO. : 8,575,836 B2
APPLICATION NO. : 12/796549
DATED : November 5, 2013
INVENTOR(S) : van de Ven It is certified that error appears in the above-identified patent and that said Letters Patent is hereby corrected as shown below:

In the Specification

At column 4, line 50: “cover dispose” should be -- cover disposed --.

At column 4, line 57: “pistol from” should be -- distal from --.

At column 5, line 22: “shapes that he employed” should be -- shapes may be employed --.

At column 7, line 41: “opening may 442” should be -- opening 442 may --.

At column 9, line 1: “and aircraft” should be -- an aircraft --.

In the Claims

At column 11, line 26 (claim 35): “The LED lamp of claim 19” should be -- The LED lamp of claim 34 --.

At column 12, lines 7-8 (claim 39): “the plurality of apertures permits” should be -- the at least one aperture permits --.

At column 12, lines 10-11 (claim 40): “the plurality of apertures is not arranged” should be -- the at least one aperture is not arranged --.

Signed and Sealed this
Tenth Day of February, 2015

Michelle K. Lee

Michelle K. Lee
*Deputy Director of the United States Patent and Trademark Office*